United States Patent [19]

Brown

[11] 4,347,887

[45] Sep. 7, 1982

[54] THERMAL SHUTTERS

[76] Inventor: Lawrence P. Brown, 760 Gibbs Dr., Ithaca, Mich. 48847

[21] Appl. No.: 194,135

[22] Filed: Oct. 6, 1980

[51] Int. Cl.[3] ..... E06B 3/00

[52] U.S. Cl. ..... 160/368 R; 160/84 R

[58] Field of Search ..... 160/84 R, 354, 368 R, 160/371, 392; 428/72, 178, 181, 188, 166; 156/197, 204, 226, 227, 290, 291

[56] References Cited

U.S. PATENT DOCUMENTS

| | | | |
|---|---|---|---|
| Re. 30,254 | 4/1980 | Rasmussen | 160/84 R |
| 1,084,761 | 1/1914 | Steele . | |
| 1,238,668 | 8/1917 | Hinde . | |
| 1,988,843 | 1/1935 | Heldenbrand | 428/178 |
| 2,029,370 | 2/1936 | Heldenbrand | 5/351 |
| 2,201,356 | 5/1940 | Terrell | 156/16 |
| 2,221,059 | 11/1940 | Persson | 156/10 |
| 2,556,011 | 6/1951 | Swayze et al. | 428/188 |
| 3,443,860 | 5/1969 | Luboshez | 350/263 |
| 3,521,692 | 7/1970 | Johnson et al. | 160/1 |
| 4,005,236 | 1/1977 | Graebe | 428/72 |
| 4,085,999 | 4/1978 | Chadroudi | 350/1.1 |
| 4,095,639 | 6/1978 | Ryan | 160/84 R |
| 4,105,724 | 8/1978 | Talbot | 261/112 |

FOREIGN PATENT DOCUMENTS

| | | | |
|---|---|---|---|
| 4455 | 10/1979 | European Pat. Off. | 160/84 R |
| 756270 | 9/1956 | United Kingdom | 160/84 R |

OTHER PUBLICATIONS

Thermal Shutters and Shades by William A. Shurcliff, Brick House Publishing Co., Inc., Andover, Mass., pp. 97 and 179.

*Primary Examiner*—Peter M. Caun

*Attorney, Agent, or Firm*—Harness, Dickey & Pierce

[57] ABSTRACT

An improved thermal shutter mountable to the interior or exterior of a structure at a window thereof comprised of one sheet of material bonded to itself at spaced intervals to form a double row of cells. The sheet may be movably mounted between a mount member and a weighted member with a drawstring extending from said weighted member through said sheet and through said mount member and attached at said mount member at the window of the structure or be directly fixedly attached to the structure or the window.

7 Claims, 5 Drawing Figures

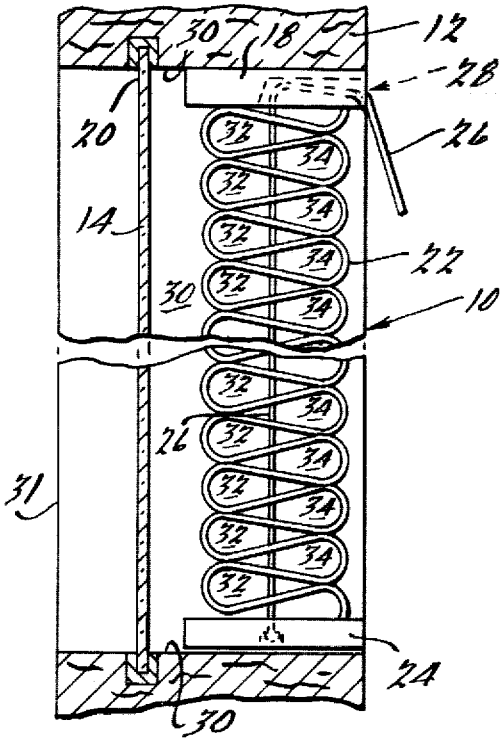
FIG. 1.
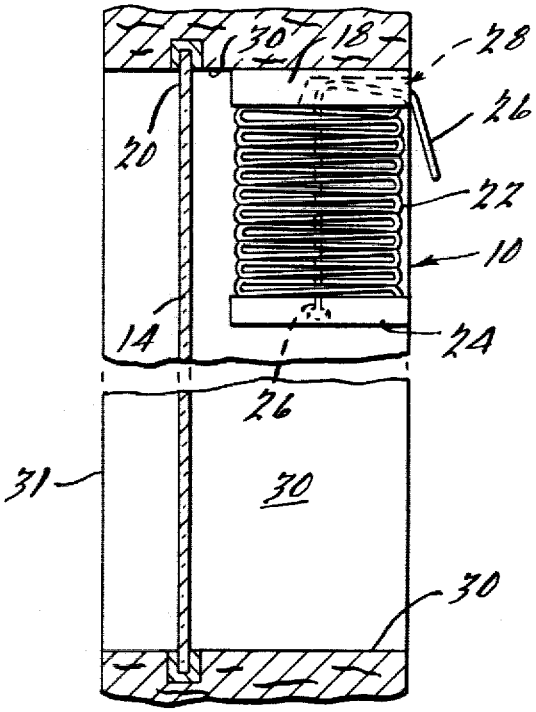
FIG. 2.
FIG. 3.
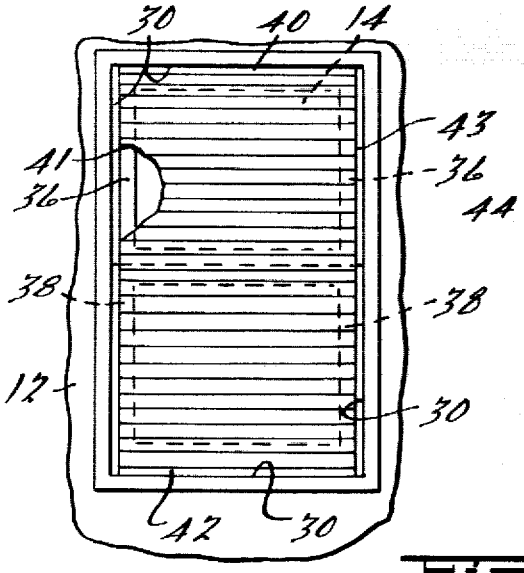
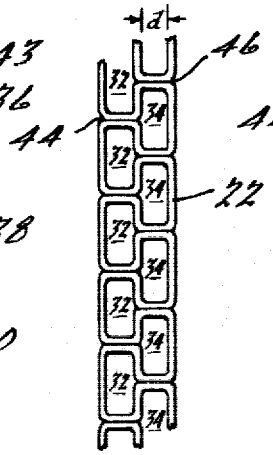
FIG. 5.
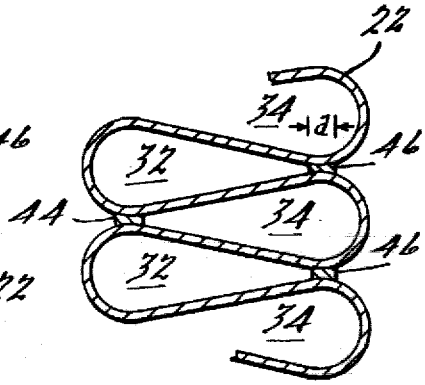
FIG. 4.

THERMAL SHUTTERS

BACKGROUND AND SUMMARY OF THE INVENTION

The present invention relates to the reduction of heat loss through windows and, in particular, the reduction of heat loss through windows utilizing a thermal shutter arrangement either on the inside or the outside of the structure in which the window is placed which also may include the option of having either a permanent shutter or a collapsible blind shutter, collapsible into a position to permit sun light to traverse the window and heat the interior area without the restriction of the thermal shutter.

Energy conservation in housing structures has become more and more important as heating bills increase higher and higher, particularly in areas where the winter climate can necessitate daily heating of the structure. One particularly notable use where a great deal of glass must be used in the housing structure and retention of heat is extremely important is a greenhouse. The use of glass, however, is also becoming more and more accepted as tremendously aesthetically appealing in both commercial and residential structures. Alternatively, insulating windows to keep cool air within a structure in warm climates is also significantly important.

Thermal insulating curtains, especially for use in greenhouses, are known to the art. The structures, however, generally comprise honeycomb cross sections utilizing a series of plastic or other materials bonded or quilted at regular intervals between the sheets or a plurality of superimposed unidirectionally arranged tubular members with common slat-like partitions between each two adjacent tubular members. The present invention utilizes only one sheet of material to develop a series of cells to form the thermal shutter. The cells are formed as the material is turned upon itself and bonded to itself to form a planar structure mountable to a fixed strip of wood or metal in turn mountable on the inside or the outside of a window in a movable fashion or mountable permanently to a window structure by batten strips or the like. The present invention also has the further object of providing such a construction having a double row of cells to insulate the window area with a quadruple glazing (window glass and three layers of material) effect while also utilizing only one sheet of material for the shutter.

One embodiment of the present invention utilizes a transparent plastic material as the sheet of material to provide the object of allowing a view out the window or letting light in through the window while also insulating the window area. Such a construction is also very low cost with simple, easy installation on either the inside or outside of the window, on a permanent or movable basis.

Other objects and advantages of the instant invention will be apparent from the following specification, claims and drawings.

BRIEF DESCRIPTION OF THE DRAWINGS

FIG. 1 is a side sectional view of a thermal shutter of the present invention mounted on the inside of a window;

FIG. 2 is a side sectional view of the device of the present invention in a position drawn upwardly to position of inoperability;

FIG. 3 is an elevated front view of the device of the present invention permanently mounted to the window structure;

FIG. 4 is an enlarged side sectional view of the cellular structure of the shutter of the present invention;

FIG. 5 is a view similar to FIG. 4 wherein the shutter is extended in a stretched or tensioned manner.

DESCRIPTION OF THE PREFERRED EMBODIMENT

Referring now to FIG. 1, an improved thermal shutter 10 embodying the principles of the instant invention is shown mounted to the interior of a structure 12, such as a residential house, a greenhouse, or any similar structure, having a window 14. The thermal shutter 10 is comprised of a longitudinally extending mount 18 made of wood or metal mounted to the structure 12 adjacent the upper portion 20 of the window 14. A cellular sheet 22 extends downwardly from said mount 18 to a weighted member 24 with a drawstring 26 extending from said weighted member 24 through said sheet 22 through operating means 28 in said fixed member 18 to a position accessible by a person desiring to control the attitude of the shutter 10. A latch-lock mechanism (not shown) or a cleat (not shown) may also be provided to permit the operator to set the position of the weighted member 24 (and thereby the shutter 10) at any position and have the member 24 be held in that position.

In FIG. 2, the thermal shutter 10 is shown in a raised position. The height to which the weighted member 24 can be raised depends on the thickness and amount of material used for the sheet portion 22 of the shutter 10. The width of the sheet 22 should correspond to the size of the window casing 30 to reduce infiltration at the interface of the window 14 and casing 30 as much as possible. FIGS. 1 and 2 are meant entirely for illustration and the dimensions there shown are not meant to limit the scope of the invention in any manner. It must also be noted that the thermal shutter 10 may also be readily mounted to the external side 31 of the structure 12, although ancillary holding means (not shown) may be needed to further secure the extended shutter 10 in place against adverse environmental effects.

The sheet 22 may be of any type of heat insulating material. Although the material may be opaque or translucent if so desired, the preferred embodiment utilizes a transparent sheet of plastic as the sheet material 22. In the present invention, only one continuous sheet is used which is bonded to itself, as shown in FIG. 4, to create a double row of cells 32 and 34. The transparent sheet allows a person to look through the window even when the shutter is in the down (FIG. 1) position. The double row of cells, 32, 34 creates a horizontal dead air spaces which reduce convective currents and also reduces heat conduction outwardly from the window area to insulate the window area while also utilizing only one sheet of material, a concept not found in the prior art.

An alternative embodiment of the present invention is illustrated in FIG. 3. The sheet 22 is permanently affixed to either the inside or outside of the window 14 on the window casing 30 by stretching the sheet 22 the length and width of the window 14 and fixedly pressing the edges of the sheet 22 against the sash portions 36 and 38 by means of battens 40, 41, 42, and 43 fixedly secured to the window casing 30 by suitable fasteners. This permanently mounted embodiment of the present invention can be secured to the inside, the outside, or both the inside and outside of the window 14, to provide, in addition to all of the advantages of the movable embodiment, also the advantage of offering the quadruple glazing with significantly reduced infiltration around the sash-glass and sash-casing interfaces.

The welded or glued portion 44 or 46 extends the width of the shutter 10 at spaced intervals along the length of the sheet 22 and has a depth "d" suitable so that when the shutter 10 is extended, the depth of the weld will keep spacing between the double row of cells 32, 34. This depth "d" is particularly critical from both an aesthetic and functional standpoint when the shutter 10 is extended a position of tension by stretching the shutter 10 in either the movable or permanently fixed embodiments. The stretching would produce the configuration illustrated by FIG. 5 with the depth "d" of the weld providing the thickness of the cells 32, 34. The configuration of FIG. 5 is also most appealing from the standpoints of viewability through the shutter 10 and window 14 and the allowance of light to illuminate the interior of the structure 12.

Thus, there is disclosed in the above description and in the drawings embodiments of the invention which fully and effectively accomplish the objects thereof and insulate a housing structure at a window yet allowing a view and letting light into the interior of the structure. The shutter described herein is simple and easy to install regardless whether or not installation is desired on the inside or the outside of the window in a movable or permanent manner onto the structure. However, it will be apparent that variations in the details of the described embodiments may be indulged in without departing from the sphere of the invention herein described, or the scope of the appended claims.

What is claimed is:

1. In a window assembly having a sash portion with glazing therein and a casing surrounding said sash portion, the improvement comprising a thermal insulating system having:

a continuous single sheet of relatively compliant material bonded to itself at spaced intervals to form a plurality of adjacent elongated cells arranged in a double row configuration and disposed adjacent to but spaced from said sash portion on said casing, said double row of elongated cells having generally coplanar outer portions collectively forming a pair of generally parallel outer thermal insulating members and having coplanar inner portions collectively forming a common intermediate thermal insulating member spaced between and generally parallel to said outer thermal insulating members, thereby providing a quadruple glazing insulating effect with the glazing in said sash portion, attachment means for securely affixing said formed continuous single sheet to said window assembly on said casing, said attachment means including batten means fixedly secured to said casing for fixedly pressing and sealingly affixing the edge portions of said formed continuous single sheet between said batten means and said casing thereby reducing infiltration through said window assembly and providing a double row of insulative dead air spaces within said elongated cells over the full area of said window assembly.

2. The improvement according to claim 1, wherein said continuous single sheet is bonded to itself along substantially its full width to form elongated bonded portions having a predetermined depth, said predetermined depth defining the spacing between said outer and intermediate thermal insulating members and thereby determining the depth of said elongated cells.

3. The improvement according to claim 2, wherein said relatively compliant material is transparent.

4. The improvement according to claim 2, wherein said relatively compliant material is translucent.

5. The improvement according to claim 2, 3 or 4, wherein the depths of said elongated bonded portions are substantially equal throughout said continuous single sheet.

6. The improvement according to claim 5, wherein said bonded portions are formed by thermally welding said continuous single sheet to itself.

7. The improvement according to claim 5, wherein said bonded portions are formed by attaching said continuous single sheet to itself with an adhesive.

* * * * *